US005444930A

United States Patent [19]

Loew

[11] Patent Number: 5,444,930

[45] Date of Patent: Aug. 29, 1995

[54] POINT OF PURCHASE CHANNEL DISPLAY SIGN WITH ELECTROLUMINESCENT LAMP

[75] Inventor: Jonathon Loew, E. Meadow, N.Y.

[73] Assignee: Design Display Group, Inc., Carlstadt, N.J.

[21] Appl. No.: 106,925

[22] Filed: Aug. 16, 1993

[51] Int. Cl.[6] ..... G09F 13/22

[52] U.S. Cl. ..... 40/544; 40/580

[58] Field of Search ..... 40/544, 542, 580; 362/84, 812

[56] References Cited

U.S. PATENT DOCUMENTS

| | | | |
|---|---|---|---|
| 2,721,808 | 10/1955 | Roberts | 40/544 |
| 2,924,902 | 2/1960 | Luck et al. | 40/649 |
| 3,161,974 | 12/1964 | Blockson | 40/544 |
| 3,182,415 | 5/1965 | Brooks | 40/544 |
| 3,404,474 | 10/1968 | Johnson | 40/544 |
| 3,517,245 | 6/1970 | Dickson, Jr. et al. | 313/109.5 |
| 3,780,430 | 12/1973 | Feeney | 29/626 |
| 4,123,751 | 10/1978 | Gladstone et al. | 340/324 M |
| 4,420,898 | 12/1983 | Moses | 40/570 |
| 4,711,547 | 12/1987 | Izuka | 354/471 |
| 4,862,153 | 8/1989 | Nakatani et al. | 340/719 |
| 4,914,348 | 4/1990 | Kameyama et al. | 313/509 |
| 5,005,306 | 4/1991 | Kinstler | 40/544 |
| 5,027,036 | 6/1991 | Ikarashi et al. | 315/169.3 |
| 5,121,234 | 6/1992 | Kucera | 359/50 |

*Primary Examiner*—Kenneth J. Dorner
*Assistant Examiner*—Cassandra Davis
*Attorney, Agent, or Firm*—Steinberg, Raskin & Davidson

[57] ABSTRACT

A point of purchase channel display sign includes an elongated channel member, a stencil formed of flexible sheet material received within the channel having openings defining the sign and a flat lamp including an elongated flat flexible electroluminescent lamp panel received in the channel between the web and the stencil, and a voltage source coupled to the flat lamp panel to illuminate the same to provide illumination through the openings in the stencil.

12 Claims, 4 Drawing Sheets

POINT OF PURCHASE CHANNEL DISPLAY SIGN WITH ELECTROLUMINESCENT LAMP

BACKGROUND OF THE INVENTION

The present invention relates generally to display devices and, more particularly, to channel display signs used at the point of purchase of goods, such as at sales counters and at shelves of supermarkets.

The promotion of a commercial product, including the manner in which the product is displayed at the point of purchase, is often important in determining the commercial success of the product. Manufacturers, wholesalers, retailers and advertisers are therefore continually searching for new point of purchase display devices which will draw a consumer's attention to a particular product. Conventional point of purchase display devices generally use elaborate lighting arrangements, graphic designs, three dimensional cutouts, fluorescent paints and the like to catch a consumer's eye.

However, the type of eye-catching techniques used in conventional point of purchase applications are generally not available for use in connection with channel display signs used at points of purchase, such as at sales counters and at shelves at supermarkets. Such channel display signs generally comprise elongated channels formed by elongated webs or walls having upper and lower flanged lips. An elongated sign or letters forming words promoting the product, or numbers specifying the price of the product, displayed at the associated counter or shelf is formed of flexible sheet material and is or are inserted into the channel. However, because of the long, narrow configuration of such point of purchase channel display signs, and the fact that their use is generally in crowded environments with little or no room for even simple "attention-getters", it has not been possible heretofore to adapt such channel display signs to provide the eye-catching quality of other point of purchase displays.

SUMMARY OF THE INVENTION

Accordingly, it is an object of the present invention to provide new and improved display devices.

Another object of the present invention is to provide new and improved point of purchase channel display signs.

Still another object of the present invention is to provide new and improved point of purchase channel display signs which are self-illuminated to provide an eye-catching quality.

A further object of the present invention is to provide new and improved self-illuminated point of purchase channel display signs in which the components associated with the self-illuminated aspect of the sign are small and easily arranged in even the crowded environments in which such point of purchase channel display signs are utilized.

A still further object of the present invention is to provide new and improved self-illuminated point of purchase channel display signs which are simple in construction and inexpensive in manufacture.

Briefly, in accordance with the present invention, these and other objects are attained by providing a point of purchase channel display sign comprising an elongated channel member including an elongated web having upper and lower longitudinally extending lips forming an elongated channel space, a stencil formed of elongated flat flexible sheet material with light transmitting openings formed therethrough received in said elongated channel space, and lamp means including an elongated flat flexible electroluminescent lamp panel received in said elongated channel space between said web and said stencil and power means coupled to said flat lamp panel to illuminate said lamp panel to provide illumination through the openings in said stencil.

The invention provides for the first time a point of purchase channel display sign which is efficiently illuminated. The illumination provides an eye-catching quality not possible heretofore in point of purchase channel display signs. The use of a flat flexible electroluminescent lamp panel enables the channel display sign to be illuminated in a manner so that the power source for the lamp may be conveniently located at the point of purchase but out of the consumer's sight. The flexible nature of the flat electroluminescent lamp panel enables the panel to be easily received in the channel space, where it may remain either not positively affixed to the channel member or secured thereto, such as by means of adhesive.

In accordance with another aspect of the invention, a combination point of purchase product display and channel display sign comprises a shelf member having a product-supporting surface and a point of purchase channel display sign in accordance with the invention wherein the elongated channel member is integrally formed with the shelf member.

The electroluminescent lamp panel requires relatively little electrical power so that the cost of illuminating the same is practically negligible. By the same token, the electroluminescent lamp panel has a relatively long service life. A channel display sign in accordance with the invention is inexpensive to manufacture and simple to install and is therefore competitive in price with point of purchase channel display signs currently in use. Moreover, it is a simple matter to retrofit conventional channel display signs to incorporate the features of the invention.

DESCRIPTION OF THE DRAWINGS

A more complete appreciation of the present invention and many of the attendant advantages thereof will be readily understood by reference to the following detailed description when considered in connection with the accompanying drawings in which.

DESCRIPTION OF THE PREFERRED EMBODIMENTS

Figure 1:
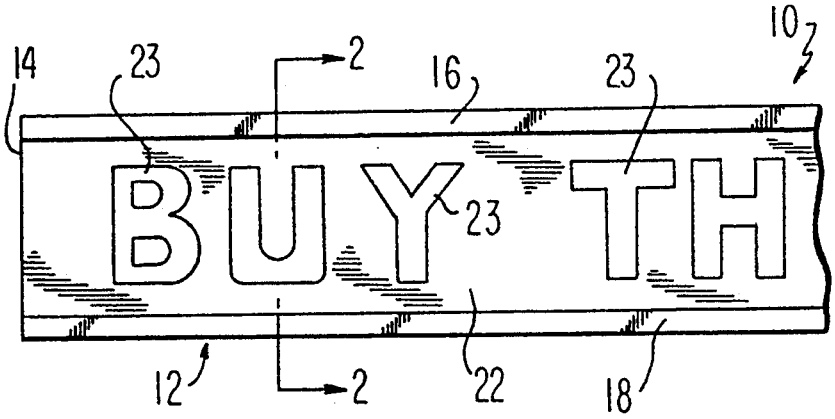
FIG. 1 is a fragmented front view of a point of purchase channel display sign in accordance with the present invention.

Referring now to the drawings wherein like reference characters designate identical or corresponding parts throughout the several views, and more particularly to FIGS. 1–4, a point of purchase channel display sign in accordance with the invention, generally designated 10, comprises an elongated channel member 12 including an elongated web 14 having upper and lower longitudinally extending lips 16 and 18 having inwardly turned flanges 16*a*, 18*a*. The web and lips form an elongated channel space 20.

In accordance with the invention a stencil 22 and lamp means 24 are received in the channel space 20. The stencil 22 comprises an elongated flat flexible sheet, preferably formed of plastic, having symbols formed therein by means of openings 23 formed through the stencil. It is understood that the openings are "light-transmitting" openings so that the stencil may comprise a continuous sheet of flexible material which is opaque except for transparent, light-transmitting regions forming the openings 26.

Figure 3:
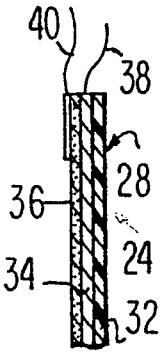
FIG. 3 is a side section view on an enlarged scale of a flat flexible electroluminescent lamp panel comprising a component of a channel display sign in accordance with the invention.
Figure 4:
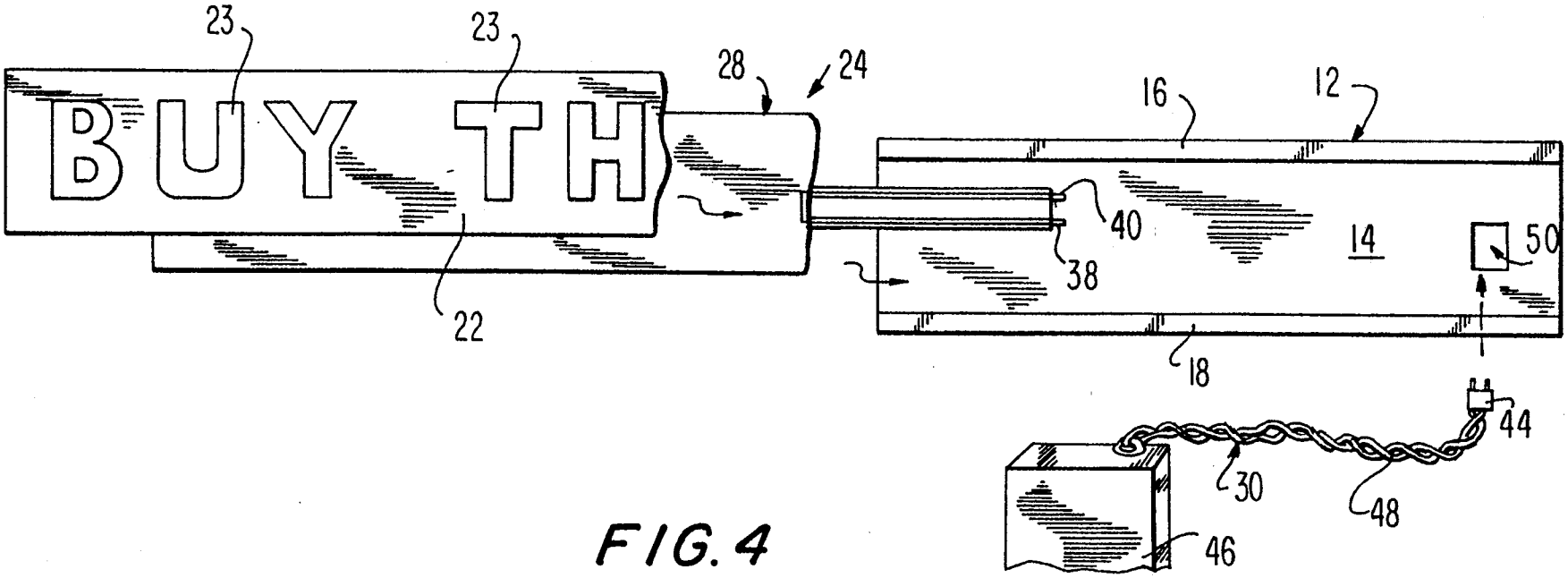
FIG. 4 is an exploded perspective view of the point of purchase channel display sign of FIG. 1.

The lamp means 24 include an elongated flat flexible electroluminescent lamp panel 28 and power means 30 coupled to the flat lamp panel 28. Referring to FIG. 3, the flat electroluminescent lamp panel comprises a flexible substrate 32 of plastic material which has a layer of foil 34 applied thereto. A layer of phosphors 36 are situated on the foil, and the entire lamp panel is preferably encapsulated in a clear plastic resin (not shown). The foil layer 34 forms a first electrode and is attached to a lead 38. A second electrode 40 is formed by a ribbon metal which is laid on top of the phosphors 36 in spaced relation to the foil layer 34. Flexible electroluminescent lamp panels of this type are conventional and are available, for example, from Quantex, Inc. of Rockville, Md.

Figure 2:
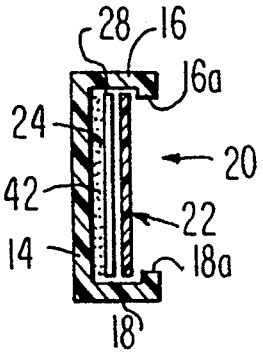
FIG. 2 is a section view taken along line 2—2 of FIG. 1.

The stencil and lamp means are appropriately shaped with an elongate strip-like configuration so as to be receivable in the channel space 20 defined by the elongated channel member 12. The electroluminescent panel 28 is preferably affixed to the web 14 of the channel member 12, such as by adhesive 42 (FIG. 2).

The power means 30 of lamp means 24 includes a voltage source 46 and conductors 48 for coupling the voltage source to the leads 38, 40 of the electroluminescent lamp panel 28 via a connector 44. An opening 50 is formed in the web 14 of the channel member 12.

In assembly, the electroluminescent lamp panel 28 is received within the channel space 20 of the channel member 12 so that the leads 38, 40 pass through the opening 50 in the channel member web 14 for connection to the conductors 48 of the voltage source 46 via connector 44. The lamp panel 28 is affixed to the web 14 by means of adhesive 42. Alternatively, the lamp panel 28 need not be affixed to the web 14 but may be held in the channel space 20 by means of the lips 16 and 18 and their respective flanges which extend over the longitudinal edges of the lamp panel. The stencil 22 is then received within the channel space 20 of the channel member 12 so that the electroluminescent lamp panel 28 is situated between the web 14 and stencil 22. The voltage source 46 may comprise a small DC battery pack and thus can be easily situated at the rear of the channel display sign 10.

Figure 5:
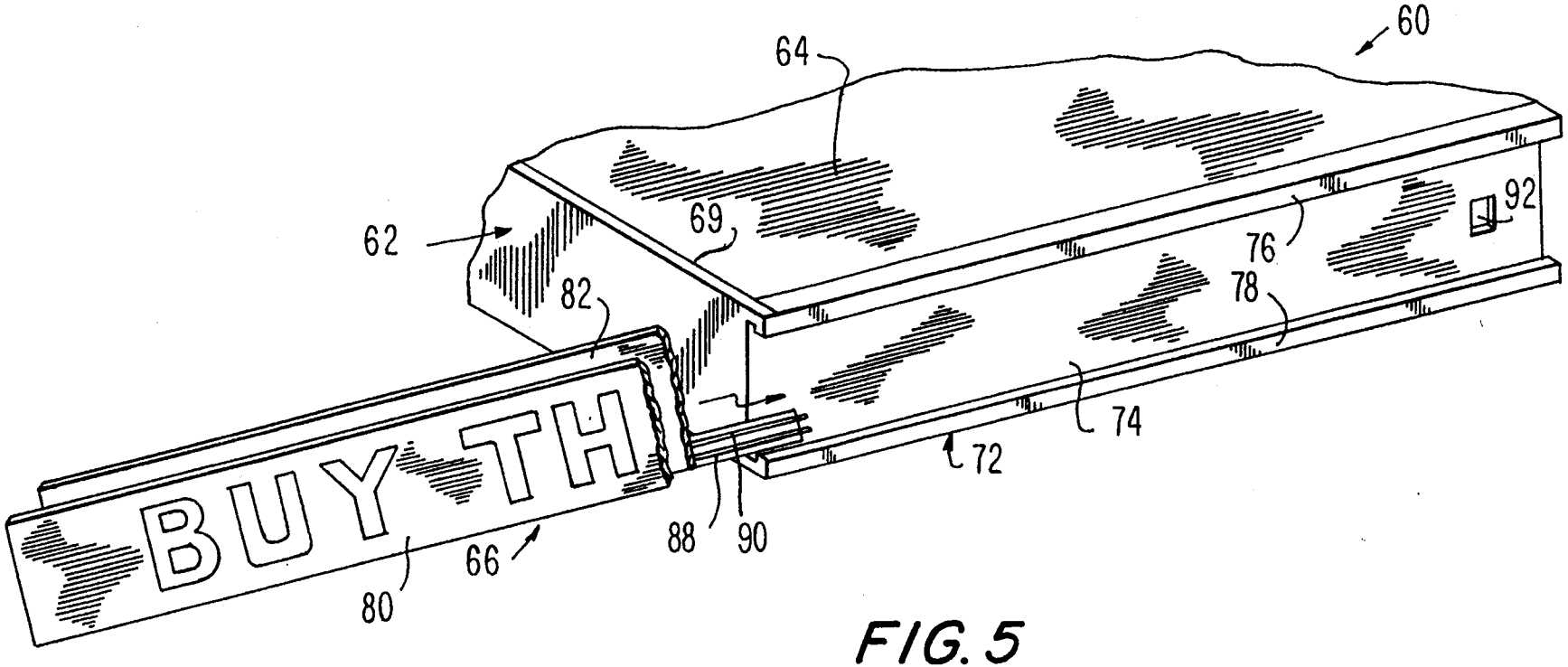
FIG. 5 is an exploded perspective view of a combination point of purchase product display and channel display sign in accordance with the invention.
Figure 6:
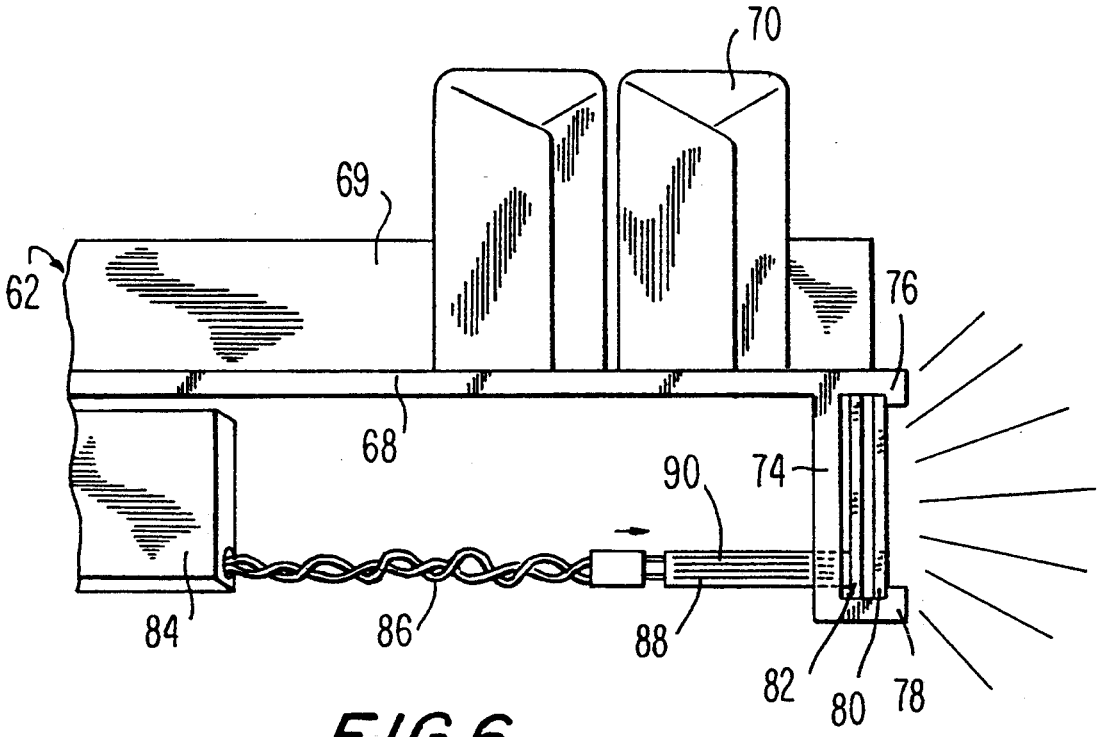
FIG. 6 is a side elevation view of the combination point of purchase product display and channel display sign illustrated in FIG. 5.

Referring now to FIGS. 5 and 6, according to another embodiment of the invention, a combination point of purchase product display and channel display sign, generally designated 60, comprises a shelf member 62 having a product-supporting surface 64, and a point of purchase channel display sign 66.

The shelf member 62 comprises a shelf 68 having an upper surface comprising the product-supporting surface 64, side walls 69 and a rear wall (not shown) forming a space within which products 70 are received. The point of purchase channel display sign forming a part of the combination includes an elongate channel portion 72 having an elongated wall 74 integrally formed with the shelf member 62, upper and lower longitudinally extending lips 76 and 78, a stencil 80 similar to stencil 22 of the embodiment of FIGS. 1–4, and lamp means 82 similar to the lamp means 24 of the embodiment of FIGS. 1–4.

The lamp means 82 further comprise a voltage source 84 in the form of a DC battery pack and conductors 86 which are coupled to the elongated flat flexible electroluminescent lamp panel through leads 88 and 90 which extend through an opening 92 formed in wall 74. As seen in FIG. 6, the voltage source 84 is easily and conveniently positioned beneath the wall 68 of shelf member 62.

Thus, in accordance with the invention, a point of purchase channel display sign is provided which is illuminated in a simple and inexpensive manner to provide an eye-catching quality not heretofore possible in point of purchase channel display signs of the type with which the invention is concerned. By providing lamp means in the form of a flat flexible electroluminescent lamp, it is a simple matter to associate the lamp with the elongated channel member of the channel display sign. The nature of the electroluminescent lamp panel also permits the use of a compact voltage source which is easily and conveniently associated with the display sign.

Obviously, numerous modifications and variations of the present invention are possible in the light of the above teachings. It is therefore to be understood that within the scope of the claims appended hereto, the invention may be practiced otherwise than as specifically disclosed herein.

I claim:

1. A point of purchase channel display sign comprising:

an elongated channel member including an elongated web having an opening extending therethrough and upper and lower longitudinally extending lips forming an elongated channel space;

a stencil including an elongated flat flexible sheet with symbols formed by openings formed therethrough, said stencil received in said elongated channel space; and lamp means including an elongated flat flexible electroluminescent lamp panel received in said elongated channel space between said web and said stencil, and power means coupled to said lamp panel to illuminate said lamp panel to provide illumination through the openings in said stencil, said power means including a voltage source and conductors for coupling said voltage source to said lamp panel, said conductors passing through said opening formed in said web of said channel member.

2. A point of purchase channel display sign as recited in claim 1 further including means for affixing said electroluminescent panel to said web of said channel member.

3. A point of purchase channel display sign as recited in claim 2 wherein said affixing means includes adhesive material.

4. A point of purchase channel display sign as recited in claim 1 wherein said electroluminescent panel comprises a laminated structure including a flexible substrate of plastic material, a foil layer situated on said substrate and a layer of phosphors situated on said foil.

5. A point of purchase channel display sign comprising:

an elongated channel member including an elongated web having an opening extending therethrough and upper and lower longitudinally extending lips forming an elongated channel space; and lamp means including an elongated flat flexible electroluminescent lamp panel received in said elongated channel space and affixed to said web, and power means coupled to said flat lamp panel to illuminate said lamp panel to provide illumination, said power means including a voltage source and conductors for coupling said voltage source to said lamp panel, said conductors passing through said opening formed in said web of said channel member.

6. A combination point of purchase product display and channel display sign, comprising:

a shelf member having a product-supporting surface; and a point of purchase channel display sign including, an elongate channel member having an elongated wall integrally formed with said shelf member, and upper and lower longitudinally extending lips forming an elongated channel space with said elongated wall, said elongated wall having an Opening extending therethrough, a stencil including an elongated flat flexible sheet with symbols formed by openings formed therethrough received in said elongated channel space, and lamp means including an elongated flat flexible electro-luminescent lamp panel received in said elongated channel space between said wall and said stencil, and power means coupled to said lamp panel, said power means comprising a voltage source and conductors for coupling said voltage source to said lamp panel, said conductors passing through said opening formed in said wall of said channel member.

7. The combination recited in claim 6 further including means for affixing said electroluminescent panel to said wall of said channel member.

8. The combination of claim 7 wherein said affixing means comprises adhesive.

9. The combination recited in claim 6 wherein said electroluminescent panel comprises a laminated structure including a flexible substrate of plastic material, a foil layer situated on said substrate and a layer of phosphors situated on said foil.

10. The combination recited in claim 6 wherein said voltage source comprises a battery situated beneath said shelf member.

11. The combination recited in claim 6 wherein said shelf member further comprises side and back walls for positioning said product.

12. A point of purchase channel display sign as recited in claim 1 wherein each of said upper and lower longitudinally extending lips comprises a flange, said flanges being inwardly directed toward each other.

* * * * *